US009837039B2

(12) United States Patent
Lee et al.

(10) Patent No.: US 9,837,039 B2
(45) Date of Patent: Dec. 5, 2017

(54) METHOD OF DRIVING DISPLAY PANEL, TIMING CONTROLLER FOR PERFORMING THE METHOD, AND DISPLAY APPARATUS HAVING THE SAME

(71) Applicant: SAMSUNG DISPLAY CO., LTD., Yongin, Gyeonggi-do (KR)

(72) Inventors: Dong-Hoon Lee, Hwaseong-si (KR); Jung-Won Kim, Seoul (KR); Cheol-Woo Park, Suwon-si (KR); Dong-Gyu Lee, Seoul (KR); Jae-Hyung Cho, Suwon-si (KR); Ja-Kyoung Jin, Hwaseong-si (KR)

(73) Assignee: SAMSUNG DISPLAY CO., LTD., Suwon-si, Gyeonggi-Do (KR)

( * ) Notice: Subject to any disclaimer, the term of this patent is extended or adjusted under 35 U.S.C. 154(b) by 131 days.

(21) Appl. No.: 14/804,921

(22) Filed: Jul. 21, 2015

(65) Prior Publication Data

US 2016/0063934 A1 Mar. 3, 2016

(30) Foreign Application Priority Data

Aug. 28, 2014 (KR) ..... 10-2014-0113423

(51) Int. Cl.
*G09G 3/36* (2006.01)

(52) U.S. Cl.
CPC ..... *G09G 3/3696* (2013.01); *G09G 3/3611* (2013.01); *G09G 3/3688* (2013.01); *G09G 2320/0233* (2013.01); *G09G 2320/0285* (2013.01); *G09G 2320/041* (2013.01); *G09G 2340/16* (2013.01)

(58) Field of Classification Search
CPC .. G09G 3/3696; G09G 3/3611; G09G 3/3688; G09G 2320/0233; G09G 2320/0285; G09G 2320/041; G09G 2340/16
See application file for complete search history.

(56) References Cited

U.S. PATENT DOCUMENTS

2004/0252111 A1* 12/2004 Cheon ..... G09G 3/20 345/204
2010/0311494 A1* 12/2010 Miller ..... A63F 1/18 463/22

(Continued)

FOREIGN PATENT DOCUMENTS

JP 2007-139936 6/2007
KR 1020080046981 5/2008

(Continued)

*Primary Examiner* — Charles Hicks
(74) *Attorney, Agent, or Firm* — F. Chau & Associates, LLC

(57) ABSTRACT

A method of driving a display panel is provided. The method includes generating first compensated and second compensated data based on input image data, outputting the first compensated data to a data driver during a first frame, outputting the first smoothing data to the data driver during a second frame subsequent to the first frame, and outputting the second compensated data to the data driver during an n-th frame subsequent to the second frame (where n is a natural number greater than two). The first smoothing data has a value between a value of the first compensated data and a value of the second compensated data.

18 Claims, 7 Drawing Sheets

(56) References Cited

U.S. PATENT DOCUMENTS

| | | | | |
|---|---|---|---|---|
| 2011/0057959 | A1* | 3/2011 | Park | G09G 3/3648 345/690 |
| 2011/0279466 | A1* | 11/2011 | Park | G09G 3/3648 345/581 |
| 2014/0168137 | A1* | 6/2014 | Pyo | G06F 3/0412 345/174 |
| 2014/0168189 | A1* | 6/2014 | Kim | G09G 3/3233 345/212 |
| 2014/0176409 | A1* | 6/2014 | Kim | G09G 3/3233 345/92 |
| 2014/0176516 | A1* | 6/2014 | Kim | G09G 3/3233 345/204 |
| 2015/0062137 | A1* | 3/2015 | Yu | G09G 3/3233 345/531 |

FOREIGN PATENT DOCUMENTS

| | | |
|---|---|---|
| KR | 2012-0094957 | 8/2012 |
| KR | 1020140006404 | 1/2014 |

* cited by examiner

FIG. 4A

| FRAME | 1 | 2 |
|---|---|---|
| SMOOTHING DATA | C1 | C2 |

FIG. 4B

| FRAME | 1 | 2 | ··· | n |
|---|---|---|---|---|
| SMOOTHING DATA | C1 | SC1 | ··· | C2 |

FIG. 4C

| FRAME | 1 | 2 | 3 | 4 | ··· | n |
|---|---|---|---|---|---|---|
| SMOOTHING DATA | C1 | SC1 | SC2 | SC3 | ··· | C2 |

FIG. 4D

| FRAME | 1 | 2 | ··· | 481 |
|---|---|---|---|---|
| SMOOTHING DATA | 128 | 129 | ··· | 150 |

| FRAME | 1 | 2 | ··· | 241 |
|---|---|---|---|---|
| SMOOTHING DATA | 128 | 129 | ··· | 150 |

| FRAME | 1 | 2 | ··· | 241 |
|---|---|---|---|---|
| SMOOTHING DATA | 128 | 129 | ··· | 139 |

| FRAME | 1 | 2 | ··· | 121 |
|---|---|---|---|---|
| SMOOTHING DATA | 128 | 129 | ··· | 139 |

METHOD OF DRIVING DISPLAY PANEL, TIMING CONTROLLER FOR PERFORMING THE METHOD, AND DISPLAY APPARATUS HAVING THE SAME

CROSS-REFERENCE TO RELATED APPLICATION

This application claims priority under 35 U.S.C. §119 to Korean Patent Application No. 10-2014-0113423, filed on Aug. 28, 2014, in the Korean Intellectual Property Office (KIPO), the disclosure of which is incorporated by reference herein in its entirety.

TECHNICAL FIELD

Exemplary embodiments of the present inventive concept relate to a display device, and more particularly, to a method of driving a display panel, a timing controller for performing the method, and a display apparatus including the timing controller.

DISCUSSION OF THE RELATED ART

A display apparatus includes a display panel, a timing controller, a data driver, and a gate driver. The timing controller may generate compensated data based on input image data received from an external device and output the compensated data to the data driver.

The timing controller may generate the compensated data based on a look-up table corresponding to the input image.

SUMMARY

An exemplary embodiment of the present inventive concept provides a method of driving a display panel. According to the method, first compensated data and second compensated data are generated based on input image data. The first compensated data is outputted to a data driver during a first frame. First smoothing data is outputted to the data driver during a second frame subsequent to the first frame. The first smoothing data has a value between a value of the first compensated data and a value of the second compensated data. The second compensated data is outputted to the data driver during an n-th frame subsequent to the second frame, where n is a natural number greater than two.

In an exemplary embodiment of the present inventive concept, second smoothing data through (n−2)-th smoothing data may be outputted to the data driver during a third frame through an (n−1)-th frame, respectively. Each of the second smoothing data through the (n−2)-th smoothing data may have a value between the value of the first smoothing data and the value of the second compensated data. The third frame through the (n−1)-th frame are between the second frame and the n-th frame.

In an exemplary embodiment of the present inventive concept, a value of (n−3)-th smoothing data corresponding to the (n−2)-th frame may be equal to or smaller than a value of the (n−2)-th smoothing data corresponding to the (n−1)-th frame subsequent to the (n−2)-th frame when the value of the second compensated data is greater than the value of the first smoothing data. The value of the (n−3)-th smoothing data corresponding to the (n−2)-th frame may be equal to or greater than the value of the (n−2)-th smoothing data corresponding to the (n−1)-th frame when the value of the second compensated data is smaller than the value of the first smoothing data.

In an exemplary embodiment of the present inventive concept, a temperature value of the display panel may be measured. The first compensated data and the second compensated data may be generated based on the measured temperature value.

In an exemplary embodiment of the present inventive concept, a first difference between the value of the first compensated data and the value of the second compensated data may be compared with a reference value. The first compensated data may be outputted to the data driver during the first frame and the second compensated data may be outputted to the data driver during the second frame when the first difference is smaller than the reference value.

In an exemplary embodiment of the present inventive concept, n may be determined based on a first difference between the value of the first compensated data and the value of the second compensated data.

In an exemplary embodiment of the present inventive concept, n may increase when the first difference increases.

An exemplary embodiment of the present inventive concept provides a timing controller. The timing controller includes a compensating part and a smoothing part. The compensating part is configured to generate first compensated data and second compensated data based on input image data. The smoothing part is configured to output the first compensated data during a first frame, to output first smoothing data during a second frame subsequent to the first frame, and to output the second compensated data during an n-th frame subsequent to the second frame (where n is a natural number greater than two). The first smoothing data has a value between a value of the first compensated data and a value of the second compensated data.

In an exemplary embodiment of the present inventive concept, the smoothing part may be configured to output second smoothing data through (n−2)-th smoothing data during a third frame through an (n−1)-th frame, respectively. Each of the second smoothing data through the (n−2)-th smoothing data may have a value between the value of the first smoothing data and the value of the second compensated data. The third frame through the (n−1)-th frame may be between the second frame and the n-th frame.

In an exemplary embodiment of the present inventive concept, a value of the (n−3)-th smoothing data corresponding to a (n−2)-th frame may be equal to or smaller than a value of (n−2)-th smoothing data corresponding to the (n−1)-th frame subsequent to the (n−2)-th frame when the value of the second compensated data is greater than the value of the first smoothing data. The value of the (n−3)-th smoothing data corresponding to the (n−2)-th frame may be equal to or greater than the value of the (n−2)-th smoothing data corresponding to the (n−1)-th frame when the value of the second compensated data is smaller than the value of the first smoothing data.

In an exemplary embodiment of the present inventive concept, the smoothing part may include a reference value comparing part. The reference value comparing part may be configured to compare a first difference between the value of the first compensated data and the value of the second compensated data with a reference value. The first compensated data may be outputted during the first frame. The second compensated data may be outputted during the second frame when the first difference is smaller than the reference value.

In an exemplary embodiment of the present inventive concept, the smoothing part may include a smoothing period determining part. The smoothing period determining part may be configured to determine a value of the n based on a first difference between the value of the first compensated data and the value of the second compensated data.

An exemplary embodiment of the present inventive concept provides a display apparatus. The display apparatus includes a display panel, a timing controller, and a data driver. The display panel is configured to display an image. The data driver is configured to output a data voltage to the display panel based on first compensated data, first smoothing data, and second compensated data. The timing controller includes a compensating part and a smoothing part. The compensating part is configured to generate the first compensated data and the second compensated data based on input image data. The smoothing part is configured to output the first compensated data to the data driver during a first frame, to output the first smoothing data to the data driver during a second frame subsequent to the first frame, and to output the second compensated data to the data driver during an n-th frame subsequent to the second frame (where n is a natural number greater than two). The first smoothing data has a value between a value of the first compensated data and a value of the second compensated data.

In an exemplary embodiment of the present inventive concept, the smoothing part may be configured to output second smoothing data through (n−2)-th smoothing data to the data driver during a third frame through an (n−1)-th frame, respectively. Each of the second smoothing data through the (n−2)-th smoothing data may have a value between the value of the first smoothing data and the value of the second compensated data. The third frame through the (n−1)-th frame may be between the second frame and the n-th frame.

In an exemplary embodiment of the present inventive concept, a value of the (n−3)-th smoothing data corresponding to the (n−2)-th frame may be equal to or smaller than a value of (n−2)-th smoothing data corresponding to the (n−1)-th frame subsequent to the (n−2)-th frame when the value of the second compensated data is greater than the value of the first smoothing data. The value of the (n−3)-th smoothing data corresponding to the (n−2)-th frame may be equal to or greater than the value of the (n−2)-th smoothing data corresponding to the (n−1)-th frame when the value of the second compensated data is smaller than the value of the first smoothing data.

In an exemplary embodiment of the present inventive concept, the display apparatus may further include a measuring part. The measuring part may be configured to measure a temperature value of the display panel. The compensating part may be configured to generate the first compensated data and the second compensated data based on the measured temperature value.

In an exemplary embodiment of the present inventive concept, the smoothing part may include a reference value comparing part. The reference value comparing part may be configured to compare a first difference between the value of the first compensated data and the value of the second compensated data with a reference value. The first compensated data may be outputted to the data driver during the first frame and the second compensated data may be outputted to the data driver during the second frame when the first difference is smaller than the reference value.

In an exemplary embodiment of the present inventive concept, the smoothing part may include a smoothing period determining part. The smoothing period determining part may be configured to determine a value of the n based on a first difference between the value of the first compensated data and the value of the second compensated data.

An exemplary embodiment of the present inventive concept provides a method of driving a display panel. The method includes generating first compensated data and second compensated data based on input image data, comparing a first difference between a value of the first compensated data and a value of the second compensated data with a reference value, outputting the first compensated data to a data driver during a first frame, outputting first smoothing data and the second compensated data to the data driver during a second frame and an n-th frame (where, n is a natural number greater than two), respectively when the first difference is greater than the reference value, and outputting the second compensated data to the data driver during the second frame when the first difference is smaller than the reference value. The second frame is subsequent to the first frame, and the n-th frame is subsequent to the second frame. The first compensated data has a value between the value of the first compensated data and the value of the second compensated data.

In an exemplary embodiment of the present inventive concept, the method may further include measuring a temperature value of the display panel. The first compensated data and the second compensated data may be generated based on the measured temperature value.

BRIEF DESCRIPTION OF THE DRAWINGS

The above and other features of the present inventive concept will become more apparent by describing in detail exemplary embodiments thereof with reference to the accompanying drawings, in which:

FIG. 4A is a table illustrating a plurality of compensated data corresponding to a first frame and a second frame, respectively in FIG. 2 according to an exemplary embodiment of the present inventive concept;

FIG. 4B is a table illustrating a plurality of compensated data corresponding to a first frame through an n-th frame, respectively in FIG. 2 according to an exemplary embodiment of the present inventive concept;

FIG. 4C is a table illustrating a plurality of compensated data corresponding to a first frame through an n-th frame, respectively in FIG. 2 according to an exemplary embodiment of the present inventive concept;

FIG. 4D is a table illustrating a plurality of the compensated data in FIG. 2 according to an exemplary embodiment of the present inventive concept;

DETAILED DESCRIPTION OF THE EMBODIMENTS

Hereinafter, exemplary embodiments of the present inventive concept will be described in detail with reference to the accompanying drawings.

Figure 1:
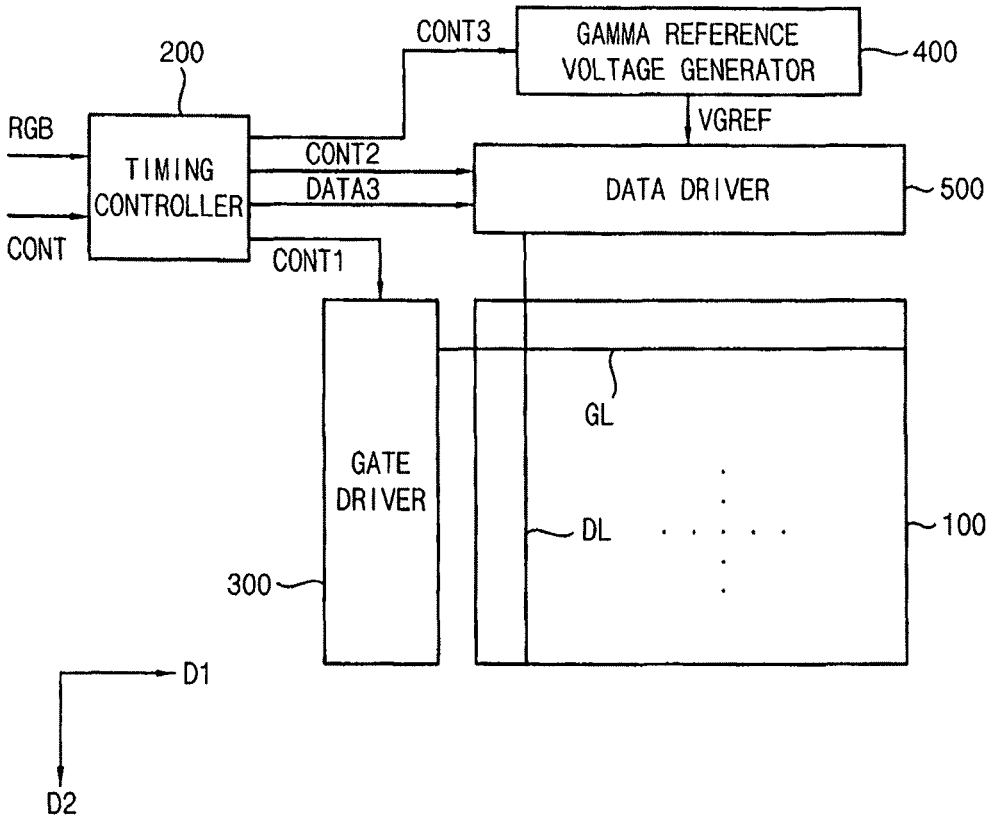
FIG. 1 is a block diagram of a display apparatus according to an exemplary embodiment of the present inventive concept.

FIG. 1 is a block diagram of a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400, and a data driver 500.

The display panel 100 includes a display region for displaying an image and a peripheral region adjacent to the display region.

The display panel 100 includes a plurality of gate lines GL, a plurality of data lines DL, and a plurality of pixels which is connected to the gate lines GL and the data lines DL. The gate lines GL extend in a first direction D1 and the data lines DL extend in a second direction D2 crossing the first direction D1.

In an exemplary embodiment of the present inventive concept, each of the pixels includes a switching element, a liquid crystal capacitor, and a storage capacitor. The liquid crystal capacitor and the storage capacitor are electrically connected to the switching element. The pixels may be arranged in a matrix configuration.

The timing controller 200 receives input image data RGB and an input control signal CONT from an external device. The input image data RGB may include red image data R, green image data G, and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DATA based on the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling operations of the gamma reference voltage generator 400 based on the input control signal CONT, and outputs the third control signal CONT3 to the gamma reference voltage generator 400.

The timing controller 200 will be described in detail with reference to FIG. 2.

The gate driver 300 generates gate signals for driving the gate lines GL in response to the first control signal CONT1 received from the timing controller 200. The gate driver 300 sequentially outputs the gate signals to the gate lines GL.

In an exemplary embodiment of the present inventive concept, the gate driver 300 may be directly mounted on the display panel 100, or may be connected to the display panel 100 as a tape carrier package (TCP) type. In an exemplary embodiment of the present inventive concept, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to each grayscale of a plurality of pixel data included in the data signal DATA.

In an exemplary embodiment of the present inventive concept, the gamma reference voltage generator may be disposed in the timing controller 200, or may be disposed in the data driver 500.

The data driver 500 receives the second control signal CONT2 and the data signal DATA from the timing controller 200, and receives the gamma reference voltage VGREF from the gamma reference voltage generator 400. The data driver 500 converts the data signal DATA to data voltages having analogue levels based on the gamma reference voltage VGREF. The data driver 500 outputs the data voltages to the data lines DL.

In an exemplary embodiment of the present inventive concept, the data driver 500 may be directly mounted on the display panel 100, or may be connected to the display panel 100 as a tape carrier package (TCP) type. In an exemplary embodiment of the present inventive concept, the data driver 500 may be integrated on the peripheral region of the display panel 100.

Figure 2:
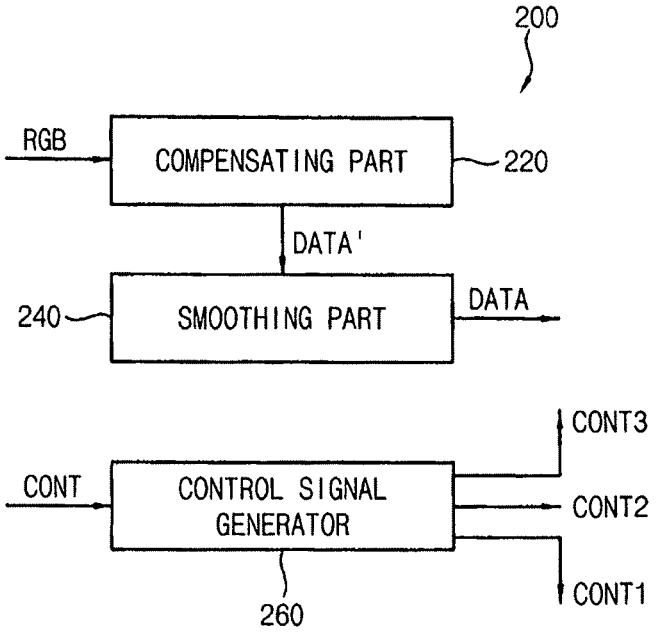
FIG. 2 is a block diagram of a timing controller in FIG. 1 according to an exemplary embodiment of the present inventive concept.

FIG. 2 is a block diagram of a timing controller in FIG. 1 according to an exemplary embodiment of the present inventive concept.

Referring to FIGS. 1 and 2, the timing controller 200 includes a compensating part 220, a smoothing part 240, and a control signal generator 260.

The compensating part 220 generates grayscale data based on the input image data RGB received from an external device. The compensating part 220 generates compensated data DATA' based on the grayscale data.

For example, the compensating part 220 generates first grayscale data corresponding to a first frame and a second frame subsequent to the first frame based on the input image data RGB. In an exemplary embodiment of the present inventive concept, the compensating part 220 generates first compensated data corresponding to the first frame based on the first grayscale data, and the compensating part 220 generates second compensated data corresponding to the second frame based on the first grayscale data.

The compensating part 220 may refer to a look-up table when generating the compensated data DATA'. For example, the compensating part 220 may refer to a first look-up table when generating the first compensated data. The compensating part 220 may refer to a second look-up table when generating the second compensated data.

The compensating part 220 outputs the compensated data DATA' to the smoothing part 240.

The smoothing part 240 smoothes the compensated data DATA' received from the compensating part 220, and outputs the data signal DATA to the data driver 500.

For example, the compensating part 220 generates the first compensated data corresponding to the first frame based on the first grayscale data. The compensating part 220 generates the second compensated data corresponding to the second frame based on the first grayscale data. In an exemplary embodiment of the present inventive concept, the smoothing part 240 may output the first compensated data to the data driver 500 during the first frame. In addition, the smoothing part 240 may output first smoothing data having a first value to the data driver 500 during the second frame. The first value of the first smoothing data may be a value between a value of the first compensated data and a value of the second compensated data. The first value of the first smoothing data may be equal to the value of the first compensated data or the value of the second compensated data. The smoothing part 240 may output the second compensated data to the data driver 500 during an n-th frame subsequent to the second frame where n is a natural number.

The smoothing part 240 may output second smoothing data through (n−2)-th smoothing data to the data driver 500 during a third frame through an (n−1)-th frame, respectively. Each of the second smoothing data through the (n−2)-th smoothing data may a value between the value of the first smoothing data and the value of the second compensated data. A value of k-th smoothing data corresponding to a (k+1)-th frame is equal to or smaller than a value of (k+1)-th smoothing data corresponding to a (k+2)-th frame (where, k is a natural number equal to or greater than two, and equal to or smaller than (n−3)) when the value of the second compensated data is greater than the value of the first smoothing data. The value of the k-th smoothing data corresponding to the (k+1)-th frame is equal to or greater than the value of the (k+1)-th smoothing data corresponding to the (k+2)-th frame when the value of the second compensated data is smaller than the value of the first smoothing data.

Each of the values of the first smoothing data through the (n−2)-th smoothing data may be rounded to the nearest integer. For example, each of the values of the first smoothing data through the (n−2)-th smoothing data may be rounded down to units. The value of the first smoothing data through the value of the (n−2)-th smoothing data may be rounded up to units.

The smoothing part 240 will be described in detail with reference to FIGS. 3A, 3B, and 3C.

The control signal generator 260 generates the first control signal CONT1, the second control signal CONT2, and the third control signal CONT3 received from an external device. The control signal generator 260 outputs the first control signal CONT1 to the gate driver 300. The control signal generator 260 outputs the second control signal CONT2 to the data driver 500. The control signal generator 260 outputs the third control signal CONT3 to the gamma reference voltage generator 400.

Figure 3A:
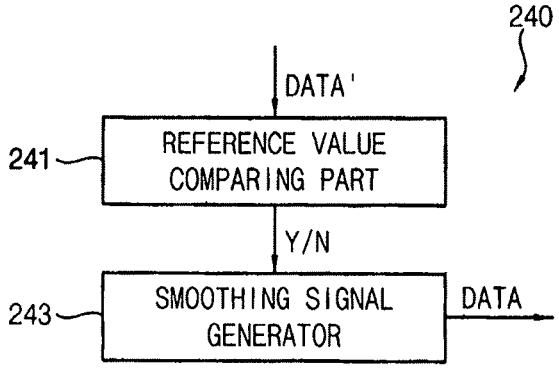
FIG. 3A is a block diagram of a smoothing part in FIG. 2 according to an exemplary embodiment of the present inventive concept.

FIG. 3A is a block diagram of a smoothing part in FIG. 2 according to an exemplary embodiment of the present inventive concept.

Referring to FIGS. 1, 2, and 3A, the smoothing part 240 may include a reference value comparing part 241 and a smoothing signal generator 243.

The compensating part 220 generates the first compensated data corresponding to the first frame based on the first grayscale data. The compensating part 220 generates the second compensated data corresponding to the second frame based on the first grayscale data.

The reference value comparing part 241 compares a difference between the value of the first compensated data and the value of the second compensated data with a reference value.

When the difference between the value of the first compensated data and the value of the second compensated data is smaller than the reference value, the smoothing signal generator 243 outputs the first compensated data to the data driver 500 during the first frame, and outputs the second compensated data to the data driver 500 during the second frame.

When the difference between the value of the first compensated data and the value of the second compensated data is greater than the reference value, the smoothing signal generator 243 outputs the first compensated data to the data driver 500 during the first frame, outputs the first smoothing data to the data driver 500 during the second frame subsequent to the first frame, and outputs the second compensated data to the data driver 500 during the n-th frame. The first smoothing data may have a value between the value of the first compensated data and the value of the second compensated data.

Figure 3B:
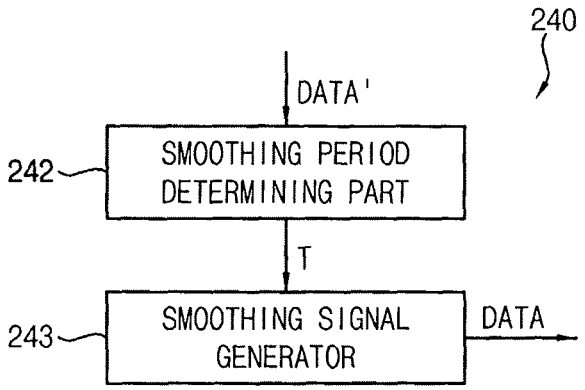
FIG. 3B is a block diagram of a smoothing part in FIG. 2 according to an exemplary embodiment of the present inventive concept.

FIG. 3B is a block diagram of a smoothing part in FIG. 2 according to an exemplary embodiment of the present inventive concept.

Referring to FIGS. 1, 2, and 3B, the smoothing part 240 may include a smoothing period determining part 242 and the smoothing signal generator 243.

The compensating part 220 generates the first compensated data corresponding to the first frame based on the first grayscale data. The compensating part 220 generates the second compensated data corresponding to the second frame based on the first grayscale data.

The smoothing period determining part 242 determines a value of n, which is a natural number, based on the difference between the value of the first compensated data and the value of the second compensated data. For example, n may increase as the difference increases, and n may decrease as the difference decreases.

The smoothing signal generator 243 outputs the first compensated data to the data driver 500 during the first frame, outputs the first smoothing data to the data driver 500 during the second frame, and outputs the second compensated data to the data driver 500 during the n-th frame subsequent to the second frame. The first smoothing data may have a value between the value of the first compensated data and the value of the second compensated data.

Figure 3C:
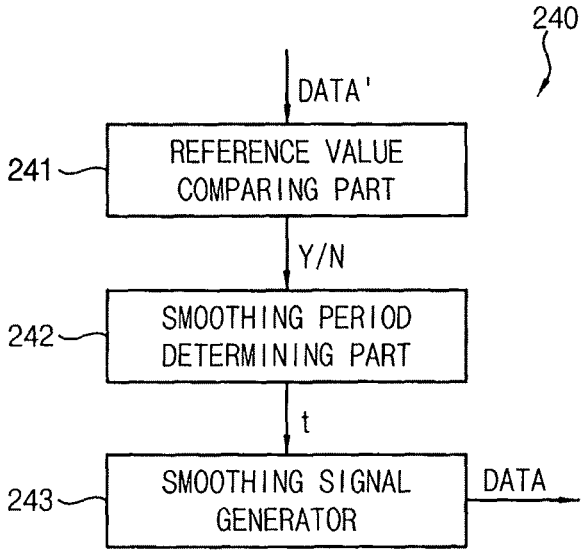
FIG. 3C is a block diagram of a smoothing part in FIG. 2 according to an exemplary embodiment of the present inventive concept.

FIG. 3C is a block diagram of a smoothing part in FIG. 2 according to an exemplary embodiment of the present inventive concept.

Referring to FIGS. 1, 2, and 3C, the smoothing part 240 may include the reference value comparing part 241, the smoothing period determining part 242, and the smoothing signal generator 243.

The compensating part 220 generates the first compensated data corresponding to the first frame based on the first grayscale data. The compensating part 220 generates the second compensated data corresponding to the second frame based on the first grayscale data.

The reference value comparing part 241 compares the difference between the value of the first compensated data and the value of the second compensated data with the reference value.

The smoothing period determining part 242 determines a value of n, which is a positive number, based on the difference between the value of the first compensated data and the value of the second compensated data. For example, n may increase as the difference increases, and n may decrease as the difference decreases.

When the difference is smaller than the reference value, the smoothing signal generator 243 outputs the first compensated data to the data driver 500 during the first frame, and outputs the second compensated data to the data driver 500 during the second frame.

When the difference is greater than the reference value, the smoothing signal generator 243 outputs the first compensated data to the data driver 500 during the first frame, outputs the first smoothing data to the data driver 500 during the second frame, and outputs the second compensated data to the data driver 500 during the n-th frame subsequent to the second frame. The first smoothing data has the value between the value of the first compensated data and the value of the second compensated data.

FIG. 4A is a table illustrating a plurality of compensated data corresponding to a first frame and a second frame, respectively in FIG. 2 according to an exemplary embodiment of the present inventive concept. FIG. 4B is a table illustrating a plurality of the compensated data corresponding to a first frame through an n-th frame in FIG. 2 according to an exemplary embodiment of the present inventive concept. FIG. 4C is a table illustrating a plurality of the compensated data corresponding to a first frame through an n-th frame in FIG. 2 according to an exemplary embodiment of the present inventive concept. FIG. 4D is a table illustrating a plurality of the compensated data in FIG. 2 according to an exemplary embodiment of the present inventive concept.

Referring to FIGS. 1, 2, 3A, 3B, 3C, 4A, 4B, 4C, and 4D, the compensating part 220 generates the first compensated data C1 corresponding to the first frame based on the first grayscale data. The compensating part 220 generates the second compensated data C2 corresponding to the second frame subsequent to the first frame based on the first grayscale data.

The compensating part 220 outputs the first compensated data C1 and the second compensated data C2 to the smoothing part 240.

Referring to FIG. 4B, the smoothing part 240 may output the first compensated data C1 to the data driver 500 during the first frame. The smoothing part 240 may output the first smoothing data SC1 to the data driver 500 during the second frame. The value of the first smoothing data SC1 may be equal to the value of the first compensated data C1 or the value of the second compensated data C2. The smoothing part 240 may output the second compensated data C2 to the data driver 500 during the n-th frame subsequent to the second frame.

The smoothing part 240 may output the second smoothing data SC2 through the (n−2)-th smoothing data to the data driver 500 during the third frame through the (n−1)-th frame, respectively. Each of the second smoothing data SC2 through the (n−2)-th smoothing data may have a value between the value of the first smoothing data SC1 and the value of the second compensated data C2. Each of the second smoothing data SC2 through the (n−2)-th smoothing data may have a value equal to the value of the first smoothing data SC1 or the value of the second compensated data C2.

When the value of the second compensated data C2 is greater than the value of the first smoothing data SC1, the value of the k-th smoothing data corresponding to the (k+1)-th frame is equal to or smaller than the value of the (k+1)-th smoothing data corresponding to the (k+2)-th frame. For example, when the value of the second compensated data C2 is greater than the value of the first smoothing data SC1, the value of the second smoothing data SC2 corresponding to the third frame may be greater than or equal to the value of the first smoothing data SC1, and a value of third smoothing data SC3 corresponding to a fourth frame may be greater than or equal to the value of the second smoothing data SC2.

When the value of the second compensated data C2 is smaller than the value of the first smoothing data SC1, the value of the k-th smoothing data corresponding to the (k+1)-th frame is equal to or greater than the value of the (k+1)-th smoothing data corresponding to the (k+2)-th frame. For example, when the value of the second compensated data C2 is smaller than the value of the first smoothing data SC1, the value of the second smoothing data SC2 corresponding to the third frame may be smaller than or equal to the value of the first smoothing data SC1, and the value of the third smoothing data SC3 corresponding to the fourth frame may be smaller than or equal to the value of the second smoothing data SC2.

Each of the values of the first smoothing data SC1 through the (n−2)-th smoothing data may be rounded to the nearest integer. Each of the values of the first smoothing data SC1 through the (n−2)-th smoothing data may be rounded down to units. Each of the values of the first smoothing data through the (n−2)-th smoothing data may be rounded up to units.

The smoothing period determining part 242 may determine a value of n, which is a positive number, based on the difference between the value of the first compensated data SC1 and the value of the second compensated data SC2. For example, n may increase as the difference between the value of the first compensated data SC1 and the value of the second compensated data SC2 increases, and n may decrease as the difference between the value of the first compensated data SC1 and the value of the second compensated data SC2 decreases. For example, n may be 480 when the difference between the value of the first compensated data SC1 and the value of the second compensated data SC2 is 22 grayscale, and n may be 240 when the difference between the value of the first compensated data SC1 and the value of the second compensated data SC2 is 11 grayscale. In an exemplary embodiment of the present inventive concept, n may be 240 when the difference is 22 grayscale, and n may be 120 when the difference is 11 grayscale.

Figure 5:
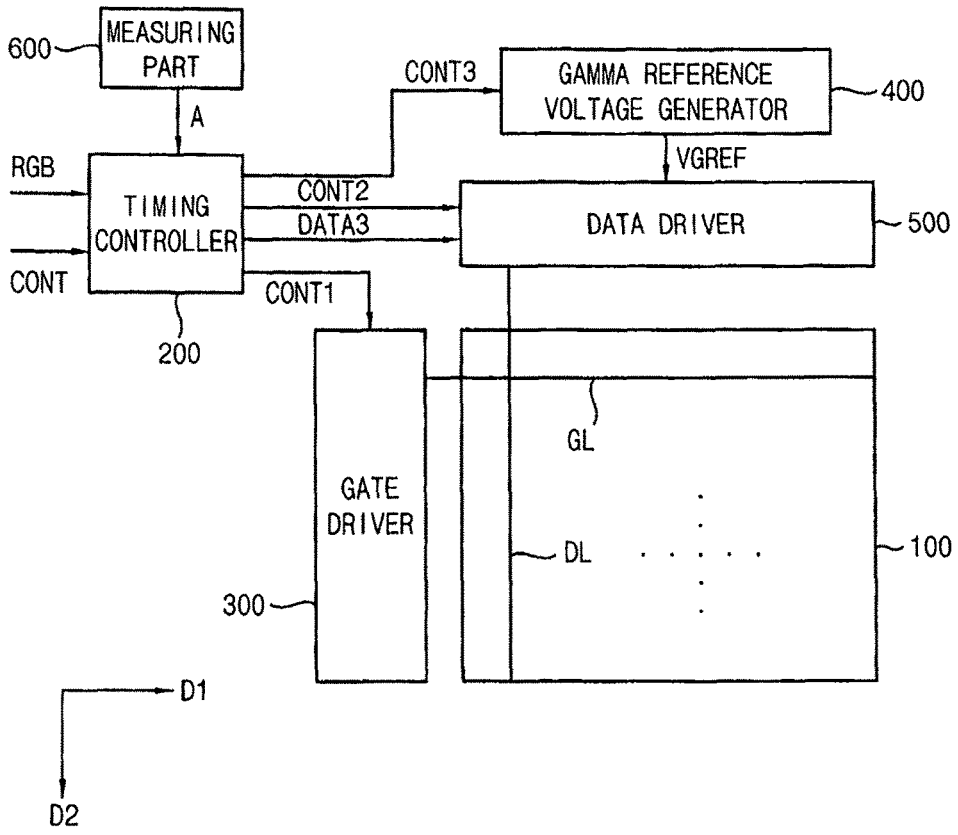
FIG. 5 is a block diagram of a display apparatus according to an exemplary embodiment of the present inventive concept.
Figure 6:
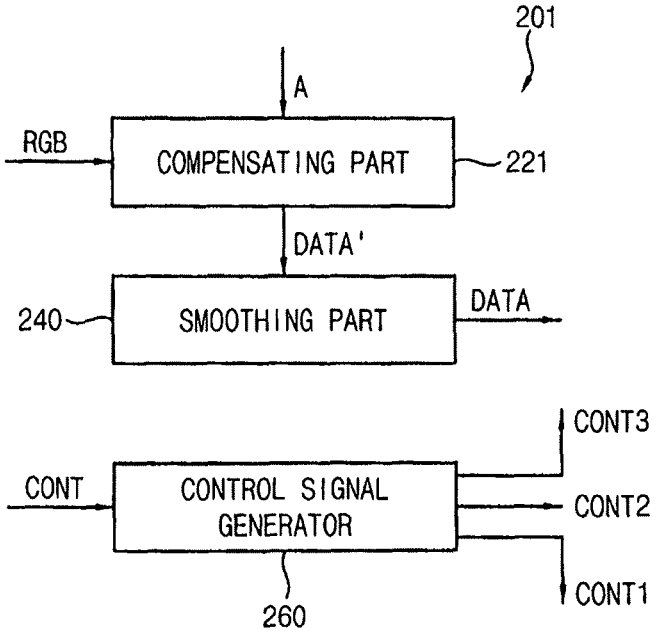
FIG. 6 is a block diagram of a timing controller in FIG. 5 according to an exemplary embodiment of the present inventive concept.

FIG. 5 is a block diagram of a display apparatus according to an exemplary embodiment of the present inventive concept. FIG. 6 is a block diagram of a timing controller in FIG. 5 according to an exemplary embodiment of the present inventive concept.

Referring to FIGS. 5 and 6, the display apparatus includes a display panel 100 and a panel driver. The panel driver includes a timing controller 201, a gate driver 300, a gamma reference voltage generator 400, a data driver 500, and a measuring part 600.

The display panel 100 includes a display region for displaying an image and a peripheral region adjacent to the display region.

The display panel 100 includes a plurality of gate lines GL, a plurality of data lines DL, and a plurality of pixels connected to the gate lines GL and the data lines DL. The gate lines GL extend in the first direction D1 and the data lines DL extend in the second direction D2 crossing the first direction D1.

In an exemplary embodiment of the present inventive concept, the pixels each include a switching element, a liquid crystal capacitor, and a storage capacitor. The liquid crystal capacitor and the storage capacitor are electrically connected to the switching element. The pixels may be arranged in a matrix configuration.

The measuring part 600 measures external data, and generates a measurement value A. The measurement value A may be a temperature of the display panel 100. The measuring part 600 outputs the measurement value A to the timing controller 201.

The timing controller 201 receives the input image data RGB and the input control signal CONT from an external device. The timing controller 201 receives the measurement value A from the measuring part 600. The measurement value A may be a temperature of the display panel 100. The input image data RGB may include the red image data R, the green image data G, and the blue image data B. The input control signal CONT may include the master clock signal and the data enable signal. The input control signal CONT may further include the vertical synchronizing signal and the horizontal synchronizing signal.

The timing controller 200 generates the first control signal CONT1, the second control signal CONT2, the third control signal CONT3, and the data signal DATA based on the measurement value A, the input image data RGB and the input control signal CONT.

The timing controller 200 generates the first control signal CONT1 for controlling the operations of the gate driver 300 based on the input control signal CONT, and outputs the first control signal CONT1 to the gate driver 300. The first control signal CONT1 may include the vertical start signal and the gate clock signal.

The timing controller 200 generates the second control signal CONT2 for controlling the operations of the data driver 500 based on the input control signal CONT, and outputs the second control signal CONT2 to the data driver 500. The second control signal CONT2 may include the horizontal start signal and the load signal.

The timing controller 200 generates the data signal DATA based on the input image data RGB and the measurement value A. The timing controller 200 outputs the data signal DATA to the data driver 500.

The timing controller 200 includes a compensating part 221, the smoothing part 240 and the control signal generator 260.

The compensating part 221 generates grayscale data based on the input image data RGB and the measurement value A. The compensating part 221 generates compensated data DATA' based on the grayscale data.

For example, the compensating part 221 generates first grayscale data corresponding to the first frame and the second frame subsequent to the first frame based on the input image data RGB and the measurement value A. In an exemplary embodiment of the present inventive concept, the compensating part 221 generates first compensated data corresponding to the first frame based on the first grayscale data. The compensating part 221 generates second compensated data corresponding to the second frame based on the first grayscale data.

The compensating part 221 may refer to a look-up table when generating the compensated data DATA'. For example, the compensating part 221 may refer to a first look-up table when generating the first compensated data. The compensating part 221 may refer to a second look-up table when generating the second compensated data.

The compensating part 221 outputs the compensated data DATA' to the smoothing part 240.

The smoothing part 240 smoothes the compensated data DATA' received from the compensating part 221, and outputs the data signal DATA to the data driver 500.

For example, the compensating part 221 generates the first compensated data corresponding to the first frame based on the first grayscale data. The compensating part 221 generates the second compensated data corresponding to the second frame based on the first grayscale data. In an exemplary embodiment of the present inventive concept, the smoothing part 240 may output the first compensated data to the data driver 500 during the first frame. The smoothing part 240 may output first smoothing data having a value between a value of the first compensated data and a value of the second compensated data to the data driver 500 during the second frame. The value of the first smoothing data may be equal to the value of the first compensated data or the value of the second compensated data. The smoothing part 240 may output the second compensated data to the data driver 500 during an n-th frame subsequent to the second frame where n is a natural number.

The smoothing part 240 may output second smoothing data through (n−2)-th smoothing data to the data driver 500 during a third frame through an (n−1)-th frame, respectively. Each of the second smoothing data through the (n−2)-th smoothing data may have a value between the value of the first smoothing data and the value of the second compensated data. For example, when the value of the second compensated data is greater than the value of the first smoothing data, a value of k-th smoothing data corresponding to a (k+1)-th frame is equal to or smaller than a value of (k+1)-th smoothing data corresponding to a (k+2)-th frame, where k is a natural number equal to or greater than two, and equal to or smaller than (n−3). For example, when the value of the second compensated data is smaller than the value of the first smoothing data, the value of the k-th smoothing data corresponding to the (k+1)-th frame is equal to or greater than the value of the (k+1)-th smoothing data corresponding to the (k+2)-th frame.

Each of the values of the first smoothing data through the (n−2)-th smoothing data may be rounded to the nearest integer. Each of the values of the first smoothing data through the (n−2)-th smoothing data may be rounded down to units. Each of the values of the first smoothing data through the (n−2)-th smoothing data may be rounded up to units.

The control signal generator 260 generates the first control signal CONT1, the second control signal CONT2, and the third control signal CONT3 received from an external device. The control signal generator 260 outputs the first control signal CONT1 to the gate driver 300. The control signal generator 260 outputs the second control signal CONT2 to the data driver 500. The control signal generator 260 outputs the third control signal CONT3 to the gamma reference voltage generator 400.

The timing controller 200 generates the third control signal CONT3 for controlling the operations of the gamma reference voltage generator 400 based on the input control signal CONT, and outputs the third control signal CONT3 to the gamma reference voltage generator 400.

The gate driver 300 generates the gate signals for driving the gate lines GL in response to the first control signal CONT1 received from the timing controller 200. The gate driver 300 sequentially outputs the gate signals to the gate lines GL.

In an exemplary embodiment of the present inventive concept, the gate driver 300 may be directly mounted on the display panel 100, or may be connected to the display panel 100 as the tape carrier package (TCP) type. In an exemplary embodiment of the present inventive concept, the gate driver 300 may be integrated on the peripheral region of the display panel 100.

The gamma reference voltage generator 400 generates the gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to each grayscale of the plurality of pixel data included in the data signal DATA.

In an exemplary embodiment of the present inventive concept, the gamma reference voltage generator may be disposed in the timing controller 200, or may be disposed in the data driver 500.

The data driver 500 receives the second control signal CONT2 and the data signal DATA from the timing controller 200, and receives the gamma reference voltage VGREF from the gamma reference voltage generator 400. The data driver 500 converts the data signal DATA to data voltages having analogue levels based on the gamma reference voltage VGREF. The data driver 500 outputs the data voltages to the data lines DL.

In an exemplary embodiment of the present inventive concept, the data driver 500 may be directly mounted on the display panel 100, or may be connected to the display panel 100 as the tape carrier package (TCP) type. In an exemplary embodiment of the present inventive concept, the data driver 500 may be integrated on the peripheral region of the display panel 100.

As described above, according to an exemplary embodiment of the present inventive concept, when a value of compensated data changes rapidly, the rapid change may be smoothened, and thus, a display quality may be increased.

The foregoing is illustrative of the present inventive concept. The present inventive concept should not to be construed as limited to the exemplary embodiments thereof. Although a few exemplary embodiments of the present inventive concept have been described, it will be understood that various modifications in form and details may be made therein without materially departing from the spirit and scope of the present inventive concept as defined in the claims.

What is claimed is:

1. A method of driving a display panel, the method comprising:

generating first compensated data and second compensated data based on input image data;

outputting the first compensated data to a data driver during a first frame;

outputting first smoothing data to the data driver during a second frame subsequent to the first frame, the first smoothing data having a value between a value of the first compensated data and a value of a second smoothing data;

outputting the second smoothing data to the data driver during a third frame subsequent to the second frame, the second smoothing data having a value between the value of the first smoothing data and a value of the second compensated data; and outputting the second compensated data to the data driver during an n-th frame subsequent to the third frame, where n is a natural number greater than three.

2. The method of claim 1, further comprising: outputting third smoothing data through (n−2)-th smoothing data to the data driver during a fourth frame through an (n−1)-th frame, respectively, wherein each of the third smoothing data through the (n−2)-th smoothing data has a value between the value of the second smoothing data and the value of the second compensated data, and wherein the fourth frame through the (n−1)-th frame are between the third frame and the n-th frame.

3. The method of claim 2, wherein a value of the (n−3)-th smoothing data corresponding to the (n−2)-th frame is equal to or smaller than a value of the (n−2)-th smoothing data corresponding to the (n−1)-th frame subsequent to the (n−2)-th frame when the value of the second compensated data is greater than the value of the second smoothing data, and the value of the (n−3)-th smoothing data corresponding to the (n−2)-th frame is equal to or greater than the value of the (n−2)-th smoothing data corresponding to the (n−1)-th frame when the value of the second compensated data is smaller than the value of the second smoothing data.

4. The method of claim 1, further comprising: measuring a temperature value of the display panel, wherein the first compensated data and the second compensated data are generated based on the measured temperature value.

5. The method of claim 1, further comprising: comparing a first difference between the value of the first compensated data and the value of the second compensated data with a reference value, wherein the first compensated data is outputted to the data driver during the first frame and the second compensated data is outputted to the data driver during the second frame when the first difference is smaller than the reference value.

6. The method of claim 1, wherein the n is determined based on a first difference between the value of the first compensated data and the value of the second compensated data.

7. The method of claim 6, wherein the n increases when the first difference increases.

8. A timing controller comprising:

a timing controller configured to generate first compensated data and second compensated data based on input image data; and the timing controller further configured to output the first compensated data during a first frame, to output first smoothing data during a second frame subsequent to the first frame, and to output the second compensated data during an n-th frame subsequent to the second frame (where n is a natural number greater than two), the first smoothing data having a value between a value of the first compensated data and a value of the second compensated data, wherein the timing controller is further configured to output second smoothing data through (n−2)-th smoothing data during a third frame through an (n−1)-th frame, respectively, wherein each of the second smoothing data through the (n−2)-th smoothing data has a value between the value of the first smoothing data and the value of the second compensate data, and wherein the third frame through the (n−1)-th frame are between the second frame and the n-th frame.

9. The timing controller of claim 8, wherein a value of the (n−3)-th smoothing data corresponding to the (n−2)-th frame is equal to or smaller than a value of (n−2)-th smoothing data corresponding to the (n−1)-th frame subsequent to the (n−2)-th frame when the value of the second compensated data is greater than the value of the first smoothing data, and the value of the (n−3)-th smoothing data corresponding to the (n−2)-th frame is equal to or greater than the value of the (n−2)-th smoothing data corresponding to the (n−1)-th frame when the value of the second compensated data is smaller than the value of the first smoothing data.

10. A timing controller comprising:

a timing controller configured to generate first compensated data and second compensated data based on input image data; and the timing controller further configured to output the first compensated data during a first frame, to output first smoothing data during a second frame subsequent to the first frame, and to output the second compensated data during an n-th frame subsequent to the second frame (where n is a natural number greater than two), the first smoothing data having a value between a value of the first compensated data and a value of the second compensated data, wherein the timing controller comprises a comparator configured to compare a first difference between the value of the first compensated data and the value of the second compensated data with a reference value, and wherein the first compensated data is outputted during the first frame and the second compensated data is outputted during the second frame when the first difference is smaller than the reference value.

11. A timing controller comprising:

a timing controller configured to generate first compensated data and second compensated data based on input image data; and the timing controller further configured output the first compensated data during a first frame, to output first smoothing data during a second frame subsequent to the first frame, and to output the second compensated data during an n-th frame subsequent to the second frame (where n is a natural number greater than two), the first smoothing data having a value between a value of the first compensated data and a value of the second compensated data, wherein the timing controller is further configured to determine a value of the n based on a first difference between the value of the first compensated data and the value of the second compensated data.

12. A display apparatus comprising:

a display panel configured to display an image; a data driver configured to output a data voltage to the display panel based on first compensated data, first smoothing data, and second compensated data; and a timing controller comprising:

a timing controller configured to generate the first compensated data and the second compensated data based on input image data; and the timing controller further configured to output the first compensated data to the data driver during a first frame, to output the first smoothing data to the data driver during a second frame subsequent to the first frame, and to output the second compensated data to the data driver during an n-th frame subsequent to the second frame (where n is a natural number greater than two), the first smoothing data having a value between a value of the first compensated data and a value of the second compensated data, wherein the timing controller is further configured to determine a value of the n based on a first difference between the value of the first compensated data and the value of the second compensated data.

13. The display apparatus of claim 12, wherein the timing controller is further configured to output second smoothing data through (n−2)-th smoothing data to the data driver during a third frame through an (n−1)-th frame, respectively, wherein each of the second smoothing data through the (n−2)-th smoothing data has a value between the value of the first smoothing data and the value of the second compensated data, and wherein the third frame through the (n−1)-th frame are between the second frame and the n-th frame.

14. The display apparatus of claim 13, wherein a value of the (n−3)-th smoothing data corresponding to the (n−2)-th frame is equal to or smaller than a value of the (n−2)-th smoothing data corresponding to the (n−1)-th frame subsequent to the (n−2)-th frame when the value of the second compensated data is greater than the value of the first smoothing data, and the value of the (n−3)-th smoothing data corresponding to the (n−2)-th frame is equal to or greater than the value of the (n−2)-th smoothing data corresponding to the (n−1)-th frame when the value of the second compensated data is smaller than the value of the first smoothing data.

15. The display apparatus of claim 12, further comprising a measuring part configured to measure a temperature value of the display panel, wherein the compensating part is configured to generate the first compensated data and the second compensated data based on the measured temperature value.

16. The display apparatus of claim 12, wherein the timing controller comprises a comparator configured to compare a first difference between the value of the first compensated data and the value of the second compensated data with a reference value, and the first compensated data is outputted to the data driver during the first frame and the second compensated data is outputted to the data driver during the second frame when the first difference is smaller than the reference value.

17. A method of driving a display panel, the method comprising:

generating first compensated data and second compensated data based on input image data; comparing a first difference between a value of the first compensated data and a value of the second compensated data with a reference value;

outputting the first compensated data to a data driver during a first frame;

outputting first smoothing data and the second compensated data to the data driver during a second frame and an n-th frame (where, n is a natural number greater than two), respectively when the first difference is greater than the reference value, wherein the second frame is subsequent to the first frame, and the n-th frame is subsequent to the second frame; and outputting the second compensated data to the data driver during the second frame when the first difference is smaller than the reference value, wherein the first compensated data has a value between the value of the first compensated data and the value of the second compensated data.

18. The method of claim 17, further comprising: measuring a temperature value of the display panel, wherein the first compensated data and the second compensated data are generated based on the measured temperature value.

* * * * *